US005082372A

United States Patent [19]

Robinson et al.

[11] Patent Number: 5,082,372

[45] Date of Patent: Jan. 21, 1992

[54] FLUID MIXING DEVICE

[75] Inventors: Andrew J. Robinson, Coventry; Carl H. Gerstung, Suffield; Alexis J. Tournaud, Ashford, all of Conn.

[73] Assignee: Gas Technology Resources Flotron, Incorporated, South Windsor, Conn.

[21] Appl. No.: 704,299

[22] Filed: May 22, 1991

[51] Int. Cl.[5] ..... B01F 5/04

[52] U.S. Cl. ..... 366/167; 366/174

[58] Field of Search ..... 366/150, 167, 176, 177, 366/182, 336, 337, 340

[56] References Cited

U.S. PATENT DOCUMENTS

| | | | |
|---|---|---|---|
| 154,544 | 9/1974 | Doten | 366/182 |
| 2,588,677 | 2/1948 | Welty et al. | 366/167 |
| 3,080,265 | 3/1963 | Maasberg | 134/167 C |
| 3,402,916 | 9/1968 | Kates | 366/167 |
| 4,966,182 | 10/1990 | Lavelle et al. | 366/336 |

*Primary Examiner*—Robert W. Jenkins
*Assistant Examiner*—Reginald L. Alexander
*Attorney, Agent, or Firm*—McCormick, Paulding & Huber

[57] ABSTRACT

An axially elongate mixing chamber defined by a mixer housing has a cylindrical sidewall and concave inwardly open hemispherical inlet and outlet end walls which form contiguous juncture with associated ends of the sidewall. A plurality of pressurized fluent materials to be mixed enter the mixing chamber from a manifold and through a common inlet passageway which terminates at a nozzle coaxially positioned within a cylindrical portion of the mixer housing. A plurality of equiangularlly spaced discharge passageways in the nozzle which terminate at discharge orifices redirect the material toward the juncture formed by the cylindrical sidewall and the hemispherical inlet end wall. A coaxial outlet orifice opens through the outlet end wall and has a cross sectional area greater than the total cross sectional area of the discharge orifices whereby a pressure drop occurs across the nozzle resulting in acceleration of the fluent material discharged from the nozzle and generally toward a turbulent mixing zone located between the nozzle and the inlet end wall. Further mixing occurs as the material moves from the mixing zone through the cylindrical portion of the chamber to the outlet end and through the outlet orifice.

15 Claims, 1 Drawing Sheet

FLUID MIXING DEVICE

BACKGROUND OF THE INVENTION

This invention relates in general to mixing devices and deals more particularly with an improved device for mixing pressurized fluent materials.

The gases and liquid materials utilized in many specialized industrial applications and processes, as, for, example, in $CO_2$, $CO_2$ laser applications and gas and liquid chromatography, are relatively expensive when purchased in ready-mixed form.

It is the general aim of the present invention to provide an improved device for general purpose gas, liquid or gas and liquid mixing applications and which offers a viable alternative to the use of ready-mixed fluent materials in specialized processes where such pre-mixed materials are required.

SUMMARY OF THE INVENTION

In accordance with the present invention a device for mixing fluent materials includes a mixer housing which defines an axially elongate fluid mixing chamber having inlet and outlet ends. The mixing chamber has a cylindrical sidewall which includes a central axis and at least one end wall defined by a surface of revolution generated about the central axis and which forms a contiguous juncture with the inlet end of the cylindrical sidewall. The device further includes conduit means for introducing into the chamber a plurality of fluids under pressure to be mixed within the chamber and which comprises an inlet conduit extending into the chamber and terminating at a nozzle disposed within a portion of the chamber defined by the cylindrical sidewall. The nozzle has at least one outwardly extending discharge passageway which communicates with the inlet conduit and terminates at its outer end at a discharge orifice. The one discharge passageway is outwardly inclined relative to the central axis and in the direction of the one end wall for directing fluid under pressure discharged from the nozzle in the general direction of the inlet end of the chamber. A means is provided for defining an outlet orifice at the outlet end of the chamber for egress of mixed fluid from the chamber. The outlet orifice has a cross sectional area greater than the cross sectional area of the discharge orifice.

DETAILED DESCRIPTION OF PREFERRED EMBODIMENT

Figure 2:
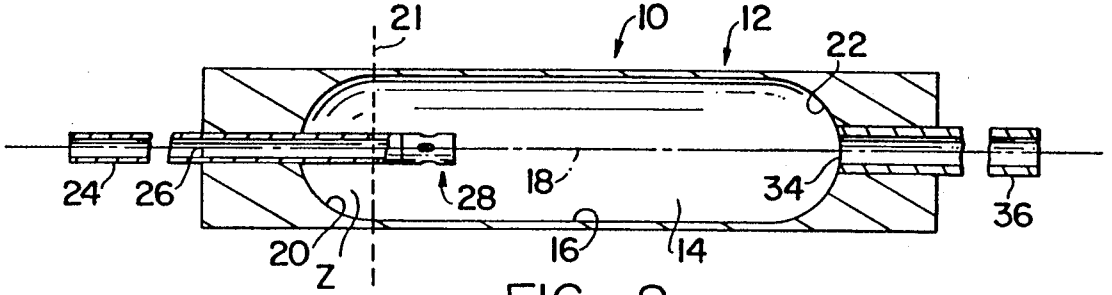
FIG. 2 is a sectional view taken along the line 2—2 of FIG. 1.
Figure 1:
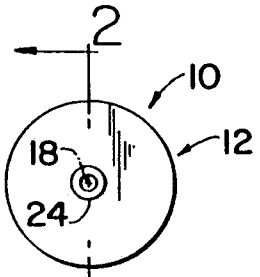
FIG. 1 is an end view of a gas mixing device embodying the present invention.

Turning now to the drawing, a fluid mixing device embodying the present invention is indicated generally by the reference numeral 10 and comprises a hollow mixer housing, indicated generally at 12. The mixer housing may be made from any suitable material compatible with the fluent materials to be mixed. However, the presently preferred mixer housing is fabricated from stainless steel.

The mixer housing 12 has an axially elongate fluid mixing chamber 14 which includes an inlet and an outlet end. The mixing chamber is partially defined by a generally cylindrical sidewall 16 which has a central axis 18 and is further defined by at least one end wall 20 formed by a surface of revolution generated about the central axis 18. The end wall 20 is preferably hemispherical, as shown, and forms a contiguous juncture with the inlet end of the cylindrical sidewall 16 the location of the juncture being indicated by the broken line 21. The illustrated chamber 14 also has another concave inwardly open end wall 22 at its outlet end. The end wall 22 is defined by another surface of revolution generated about the axis 18 and like the end wall 20 it is particylindrical or more specifically hemispherical in form, substantially as shown. Like the end wall 20, the end wall 22 forms a contiguous juncture with an associated end of the cylindrical sidewall 16.

Figure 5:
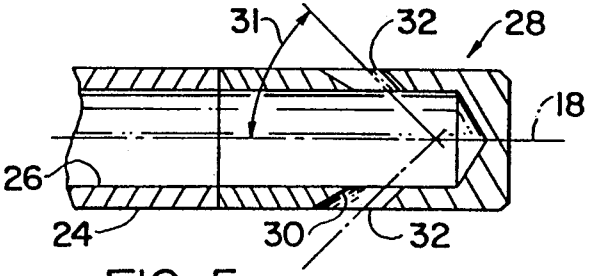
FIG. 5 is an axial sectional view taken along the line 5—5 of FIG. 4.
Figure 4:
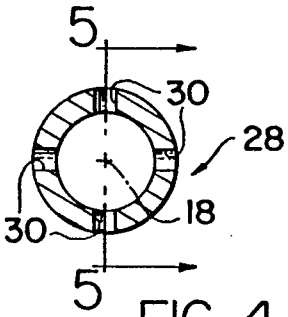
FIG. 4 is a sectional view taken along the line 4—4 of FIG. 3.
Figure 3:
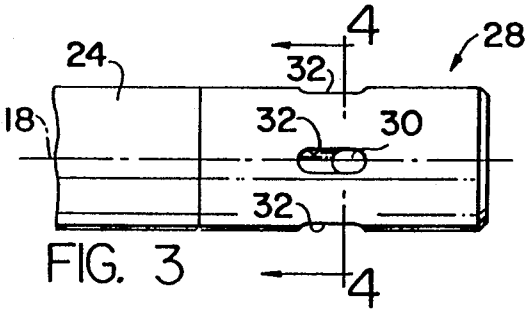
FIG. 3 is a somewhat enlarged fragmentary side elevational view of the inlet conduit and nozzle.

Fluent materials to be mixed enter the mixing chamber through an inlet conduit 24 which has a single inlet passageway 26 for simultaneously receiving all of the fluids to be mixed. The conduit 24 extends for some distance into the mixing chamber 14 and terminates within the chamber at a nozzle indicated generally at 28. Preferably, and as shown, the nozzle is disposed within a portion of the chamber defined by the cylindrical sidewall 16. The nozzle has a central axis which, as shown, is coincident with the central axis 18 of the cylindrical sidewall. At least one discharge passageway 30 formed in the nozzle communicates with the inlet passageway 26, as best shown in FIG. 5 and extends outwardly through the nozzle terminating at its outer end at a discharge orifice 32. Preferably, and as shown, the discharge passageway 30 diverges in the direction of the discharge orifice 32. However, the illustrated nozzle 28 has four such discharge passageways 30, each of which terminates at its outer end at an associated discharge orifice 32. The axis of each of the various discharge passageways 30, is outwardly inclined relative to the central axis 18 and in the direction of the inlet end wall 20 for directing fluid under pressure discharge from the nozzle in the general direction of the inlet end of the chamber 14 and form an included angle of 45 degrees with the central axis 18, as shown in FIG. 5 where the latter angle is indicated at 31.

Preferably, and as best shown in FIG. 5, the central axes of the various discharge passageways 30, intersect the central axis 18 at a common point of intersection and extend outwardly from the latter point of intersection and generally intersect proximate the juncture 21 formed by the cylindrical sidewall 16 and the end wall 20. Thus, in accordance with the presently preferred embodiment of the invention the central axes of the various equiangularly spaced discharge passageways are disposed within a common conical surface of revolution having its apex coincident with the axis 18 and forming an included angle of 45 degrees with the axes 18. Thus, each of the discharge passageways is adapted to discharge fluids under pressure toward the wall of the chamber to impinge upon the latter wall approximate an associated portion of the juncture 21.

The fluent mixture of gases, liquids or gases and liquids produced within the chamber 14 passes from the chamber through an axially concentric outlet orifice 34 defined by the end wall 22 and flows into and through an outlet conduit 36 which, as shown, extends for some distance beyond the outlet end of the mixer housing to facilitate connection of the mixing device 10 to an associated gas receiver or other processing equipment which may directly utilize the fluent mixture produced. The cross sectional area of the outlet orifice 34 is somewhat greater than the total cross sectional area of the all of the various discharge orifices 32, defined by the nozzle.

The region between the nozzle discharge orifices 32, and the hemispherical surface of the inlet end wall 20 constitutes a turbulent mixing zone indicated by the letter Z in FIG. 2. Fluids to be mixed enter the nozzle 28 through the common inlet passageway 26 and are discharged under pressure from the nozzle 28 through the four separate equiangularly spaced discharge passageways 30. In the illustrated mixing device 10 fluids are redirected through an angle of 135 degrees by the discharge passageways 30, and discharged from the nozzle toward the juncture 21 and into the turbulent mixing zone. The size differential between the outlet orifice 34 and the discharge orifices 32, cause a pressure drop across the discharge orifices at the nozzle which accelerates discharge flow velocity to create turbulence within the mixing zone Z. Mixed fluids flow from the mixing zone into the region of the chamber forward of the nozzle 28 where further mixing occurs before the mixed fluid exits from the mixing chamber through the outlet orifice 34.

Figure 6:
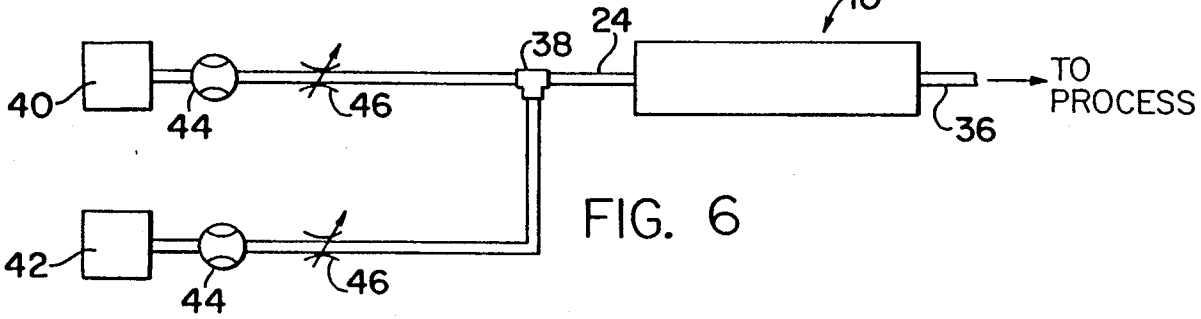
FIG. 6 is a somewhat schematic view illustrating a typical application of the device.

In FIG. 6 a typical mixing application utilizing the device 10 is illustrated somewhat schematically. The inlet conduit 24 is connected to a manifold 38 which receives fluent materials under pressure from a plurality of material sources indicated at 40 and 42. Two such fluid sources are shown for the purpose of illustration. However, the number of fluent materials to be mixed may be increased by the addition of an appropriate manifold. The fluent material from each of the sources 40 and 42 flow through a flow meter 44 and a metering valve 46 before entering the manifold 38 whereby the rate of flow of each fluent material may be regulated before the materials enter the mixing chamber 14 through the common inlet passageway 26. Mixing occurs within the mixing chamber 14, substantially as aforedescribed, after which the resulting fluent mixture exits from the mixing device 10 through the outlet conduit 36 which may be connected to an associated fluid receiver or to processing equipment for immediate usage.

We claim:

1. A fluid mixing device comprising a mixer housing having an axially elongate fluid mixing chamber including an inlet end and an outlet end, said chamber having a cylindrical sidewall including a central axis and at least one end wall defined by a surface of revolution generated about said central axis, said one end wall forming a contiguous juncture with the inlet end of said cylindrical sidewall, conduit means for introducing into said chamber a plurality of fluids under pressure to be mixed within said chamber and including an inlet conduit extending into and terminating within said chamber and a nozzle at the terminal end of said inlet conduit, said nozzle being disposed within a portion of said chamber defined by said cylindrical sidewall and having at least one outwardly extending discharge passageway communicating with said inlet conduit and terminating at its outer end at a discharge orifice, said one discharge passageway being outwardly inclined relative to said central axis and in the direction of said one end wall for directing fluid under pressure discharge from said nozzle in the general direction of said inlet end, and means defining an outlet orifice at the outlet end of said chamber for egress of mixed fluid from said chamber, said outlet orifice having a cross sectional area greater than the cross sectional area of said one discharge orifice.

2. A fluid mixing device as set forth in claim 1 wherein said one end wall is further characterized as a parti-spherical wall.

3. A fluid mixing device as set forth in claim 2 wherein said parti-spherical wall is further characterized as a hemispherical wall.

4. A fluid mixing device as set forth in claim 1 wherein said one discharge passageway is outwardly inclined in the direction of said juncture for directing fluid under pressure discharged from said nozzle toward said juncture.

5. A mixing device as set forth in claim 4 wherein said nozzle has an axis coincident with said central axis.

6. A fluid mixing device as set forth in claim 5 wherein the axis of said one discharge passageway intersects said central axis.

7. A fluid mixing device as set forth in claim 6 wherein said axis of said one discharge passageway forms an angle of 45 degrees with central axis.

8. A fluid mixing device as set forth in claim 1 wherein said chamber has another end wall at said outlet end comprising said means defining said outlet orifice.

9. A fluid mixing device as set forth in claim 8 wherein said other end wall is defined by a surface of revolution generated about said central axis and forming a contiguous juncture with the outlet end of said cylindrical side wall.

10. A fluid mixing device as set forth in claim 9 wherein said other end wall is further characterized as a parti-spherical wall.

11. A fluid mixing device as set forth in claim 9 wherein said other end wall is further characterized as a hemispherical wall.

12. A fluid mixing device as set forth in claim 1 wherein said nozzle has a plurality of discharge passageways and each of said discharge passageways terminates at an associated discharge orifice.

13. A fluid mixing device as set forth in claim 12 wherein the cross sectional area of said outlet orifice is greater than the sum of the cross sectional areas defined by the discharge orifices associated with said discharge passageways.

14. A fluid mixing device as set forth in claim 12 wherein said nozzle has an axis coincident with the said central axis and said discharge passageways are equiangularly spaced about said central axis.

15. A fluid mixing device comprising a mixer housing having an axially elongate fluid mixing chamber including an inlet end and an outlet end, said chamber having a cylindrical sidewall including a central axis and at least one end wall defined by a surface of revolution generated about said central axis, said one end wall forming a contiguous juncture with the inlet end of said cylindrical sidewall, conduit means for introducing into said chamber a plurality of fluids under pressure to be mixed within said chamber and consisting of a single inlet conduit defining a single inlet passageway extending into and terminating within said chamber and a nozzle at the terminal end of said inlet conduit, said nozzle being disposed within a portion of said chamber defined by said cylindrical sidewall and having at least one outwardly extending discharge passageway communicating with said inlet passageway and terminating at its outer end at a discharge orifice, said one discharge passageway being outwardly inclined relative to said central axis and in the direction of said one end wall for directing fluid under pressure discharged from said nozzle in the general direction of said inlet end, and means defining an outlet orifice at the outlet end of said chamber for egress of mixed fluid form said chamber, said outlet orifice having a cross sectional area greater than the cross sectional area of said one discharge orifice.

* * * * *